US007075219B2

(12) United States Patent
Kang

(10) Patent No.: US 7,075,219 B2
(45) Date of Patent: Jul. 11, 2006

(54) MASK SPRING STRUCTURE FOR CATHODE RAY TUBE

(75) Inventor: Su Dong Kang, Gumi-si (KR)

(73) Assignee: LG.Philips Displays Korea Co., Ltd., Gyeongsangbuk-do (KR)

( * ) Notice: Subject to any disclaimer, the term of this patent is extended or adjusted under 35 U.S.C. 154(b) by 240 days.

(21) Appl. No.: 10/703,557

(22) Filed: Nov. 10, 2003

(65) Prior Publication Data

US 2004/0263048 A1 Dec. 30, 2004

(30) Foreign Application Priority Data

Jun. 30, 2003 (KR) ..... 10-2003-0043288

(51) Int. Cl.
*H01J 29/80* (2006.01)

(52) U.S. Cl. ..... 313/407; 313/404

(58) Field of Classification Search ..... 313/404–407, 313/50, 269

See application file for complete search history.

(56) References Cited

U.S. PATENT DOCUMENTS 3,999,098 A * 12/1976 Dougherty ..... 313/407
5,210,459 A * 5/1993 Lee ..... 313/406
6,144,148 A * 11/2000 Tong et al. ..... 313/407
6,265,818 B1 7/2001 Adamski et al.
2003/0057818 A1* 3/2003 Ito ..... 313/404

FOREIGN PATENT DOCUMENTS

CN 1161560 A 10/1997

* cited by examiner

*Primary Examiner*—Ashok Patel
*Assistant Examiner*—Anthony Canning
(74) *Attorney, Agent, or Firm*—Birch, Stewart, Kolasch and Birch, LLP

(57) ABSTRACT

A cathode ray tube comprises a panel having a fluorescent formed on an inner surface thereof; a funnel fastened to the panel; an electron gun housed in the funnel, emitting electron beams; a shadow mask for selecting colors of the electron beams; a mask frame for supporting the shadow mask; and a mask spring for coupling the mask frame to the panel, wherein the mask spring is comprised of an fastening portion welded to the mask frame, a attaching portion attached to the panel, and a connecting portion for connecting the fastening portion with the attaching portion, and elongated embossments are formed on a bending portion formed between the fastening portion and the connecting portion.

20 Claims, 6 Drawing Sheets

◎ Thickness: 1.0mm

MASK SPRING STRUCTURE FOR CATHODE RAY TUBE

This Nonprovisional application claims priority under 35 U.S.C. § 119(a) on Patent Application No. 10-2003-0043288 filed in KOREA on Jun. 30, 2003, the entire contents of which are hereby incorporated by reference.

BACKGROUND OF THE INVENTION

1. Field of the Invention

The present invention relates in general to a cathode ray tube, more particularly, to a cathode ray tube including a mask spring having a modified structure, thereby reducing a cost of manufacture while improving performance of the mask spring.

2. Discussion of the Background Art

FIG. 1 illustrates the structure of a related art cathode ray tube and mask spring.

As shown in FIG. 1, the related cathode ray tube includes a panel 12 having a fluorescent screen 121 formed on an inner surface, a funnel 10 fastened to the panel 12, an electron gun 14 for emitting electron beams, a deflection yoke 16 for deflecting the electron beams emitted from the electron gun, and a shadow mask 18 having a plurality of electron beam passing holes through which selecting colors of the electron beams.

Also, the shadow mask 18 is connected to the mask frame 20, and the mask frame 20 is fastened on the panel 12 by means of a mask spring 30.

With the above structure, when a designated voltage is applied, the electron gun 14 emits electron beams, and these electron beams are deflected by the deflection yoke 16, pass through the electron beam passing holes formed on the shadow mask 18, and eventually collide with the fluorescent screen 121, displaying an image on a screen.

At this time, a part of the electron beams are transmitted through the electron beam passing holes on the shadow mask 18, but the other part of the electron beams collides with the shadow mask 18.

The collision, namely the kinetic energy, of those electron beams generates heat energy that is in turn transferred to the shadow mask 18. As a result, the metallic shadow mask 18 is thermally expanded by the heat energy.

This thermally expanding shadow mask is depicted in FIG. 2.

As shown in the drawing, when the shadow mask 18 undergoes thermal expansion due to the collision with the electron beams, the electron beam passing holes 19 shift from the initial positions (this phenomenon is called a doming phenomenon), so the electron beams are mis-landed deviating from where they are supposed to be landed.

In fact, mis-landing of the electron beams is the major factor of deteriorations in color purity of images. To minimize the mis-landing effect, there needs a counter-reaction against the doming phenomenon.

The mask spring 30 is what performs the counter-reaction against the doming phenomenon. Of course, as mentioned before, the shadow mask not only performs the counter-reaction against the doming phenomenon, but also supports the mask frame 20 to be fastened to the panel 12.

When the shadow mask 18 is thermally expanded because of heat conduction, the mask frame 20 and the mask spring 30 are also thermally expanded. As a result, the positions of the mask frame 20 and mask spring 30 are changed, causing the electron beams to mis-land.

FIG. 3 is a perspective view of the structure of a mask spring to which a mask frame is attached, and FIG. 4 is a plan view of a mask spring.

Referring to FIGS. 3 and 4, the mask spring 30 includes an fastening portion 31 that is welded to the mask frame 20, a attaching portion 35 that is incorporated with a stud pin formed inside the panel, and a connecting portion 33 that connects the fastening portion 31 with the attaching portion 35.

The fastening portion 31 and the connecting portion 33 are tilted at a designated angle from a bending portion 32, and the attaching portion 35 and the connection portion 33 are tilted at a designated angle from another bending portion 34.

Especially, some of criteria that manufacturers are very careful with when they choose proper materials for the mask frame 20, the shadow mask 18 and the mask spring 30 are thermal characteristics, strength and cost of manufacture. In general, the mask frame 20 is made of iron (Fe), the shadow mask 18 is made of an Fe—Ni alloy having a relatively low thermal expansion coefficient, and the mask spring 30 is made of stainless steel together with an Fe—Ni alloy.

Besides the doming phenomenon aforementioned, there is another phenomenon called a howling phenomenon where the shadow mask 18 is vibrated caused by external impacts or vibrations of a speaker. To minimize the howling of the shadow mask, manufacturers made the mask spring 30 thinner to make it absorb external impacts better.

However, if the thickness of the mask spring 30 is reduced, the counter-reaction effect of the mask spring against the doming phenomenon becomes weak, and particularly the mask spring is not able to withstand external shocks (i.e. drop characteristic) as it used to be.

SUMMARY OF THE INVENTION

An object of the invention is to solve at least the above problems and/or disadvantages and to provide at least the advantages described hereinafter.

Accordingly, one object of the present invention is to solve the foregoing problems by providing a cathode ray tube including a mask spring having a modified structure, thereby reducing a cost of manufacture while improving performance of the mask spring.

Another object of the present invention is to provide a cathode ray tube including a mask spring having an improved drop characteristic by increasing strength against shocks or impacts.

The foregoing and other objects and advantages are realized by providing a cathode ray tube including: a panel having a fluorescent formed on an inner surface thereof; a funnel welded to the panel; an electron gun housed in the funnel, emitting electron beams; a shadow mask for selecting colors of the electron beams; a mask frame for supporting the shadow mask; and a mask spring for coupling the mask frame to the panel, wherein the mask spring is comprised of an fastening portion welded to the mask frame, a attaching portion attached to the panel, and a connecting portion for connecting the fastening portion with the attaching portion, and elongated embossments are formed on a bending portion formed between the fastening portion and the connecting portion.

In an exemplary embodiment, the embossments are asymmetric with respect to the bending portion.

In an exemplary embodiment, a thickness of the mask spring is in the range of 0.4–0.8 mm.

In an exemplary embodiment, a thickness of the mask spring, t, and a width of the bending portion, w, satisfy a condition of $0.02 \leqq t/w \leqq 0.06$.

In an exemplary embodiment, a distance from the bending portion to an end of the embossment in a direction of the connecting portion, b, and a distance from the bending portion to an end of the embossment in a direction of the fastening portion, a, satisfy a condition of $a<b$.

In addition, the distance from the bending portion to the end of the embossment in the direction of the connecting portion, b, and a total length of the embossment, a+b, satisfy a condition of $0.6 \leqq b/(a+b) \leqq 0.9$.

In an exemplary embodiment, a plurality of the embossments is formed on the bending portion.

In an exemplary embodiment, a gap between centers of the embossments is in the range of 3–7 mm.

In an exemplary embodiment, a depth of each of the embossment, d, where the embossment is caved in, and a thickness of the mask spring, t, satisfy a condition of $0.4 \leqq d/t \leqq 0.6$.

Preferably, the depth of each of the embossment is less than 0.3 mm.

In an exemplary embodiment, a depth of the embossment, s, and a total length of the embossment, a+b, satisfy a condition of $0.3 \leqq s/(a+b) \leqq 0.5$.

Preferably, a width of the embossment is less than 3 mm.

Preferably, a length of the embossment is in the range of 2–8 mm.

Preferably, a width of the mask spring is in the range of 10–20 mm.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

The following detailed description will present a cathode ray tube according to a preferred embodiment of the invention in reference to the accompanying drawings.

Figure 5:
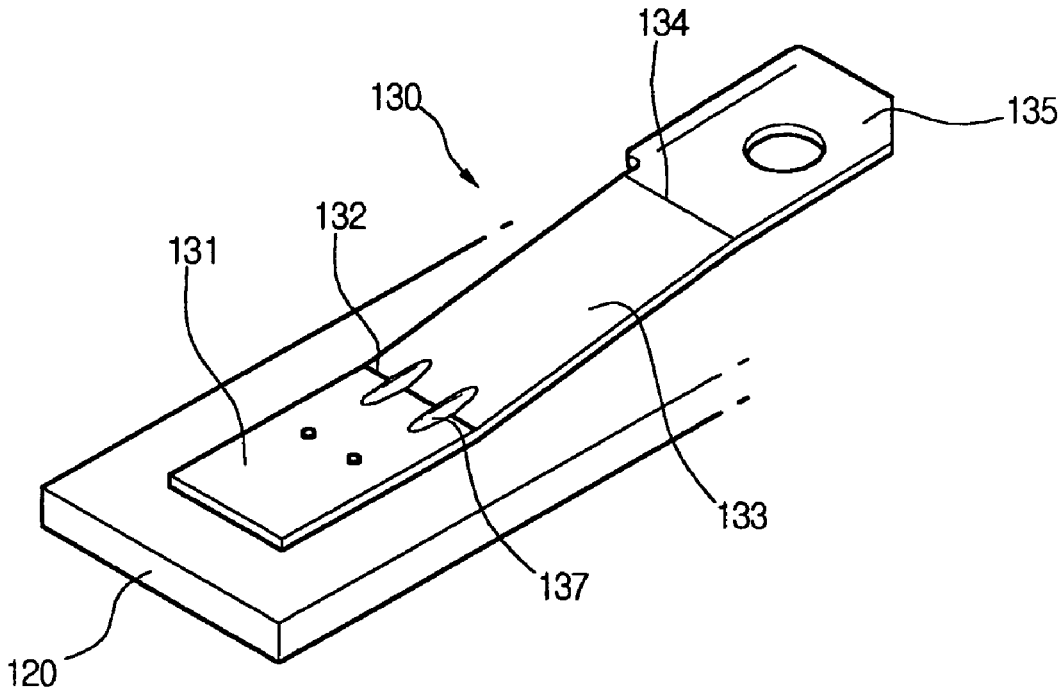
FIG. 5 is a perspective view of a mask spring of the present invention.
Figure 6:
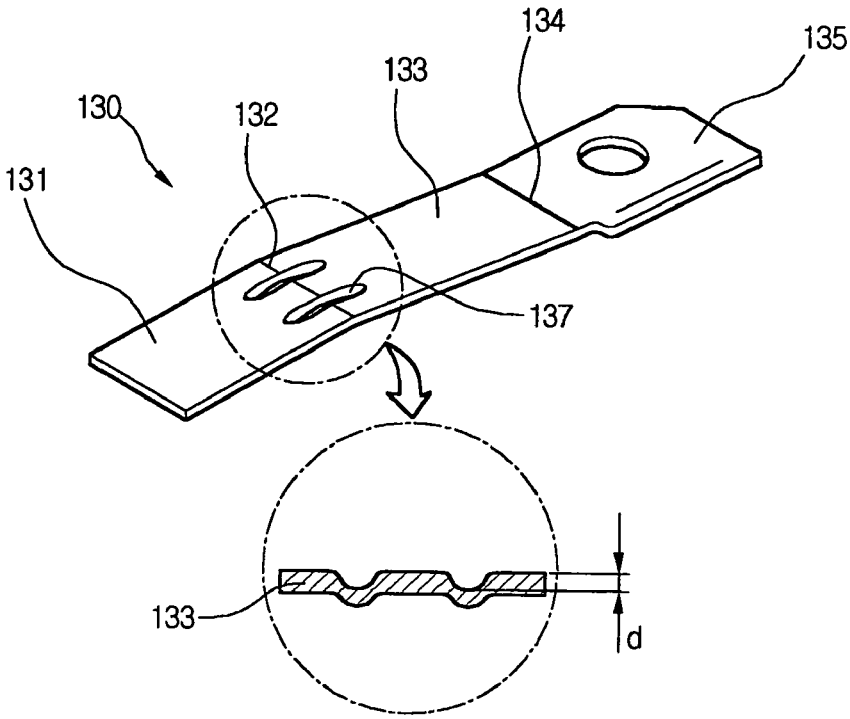
FIG. 6 is a rear perspective view of a mask spring of the present invention.
Figure 7:
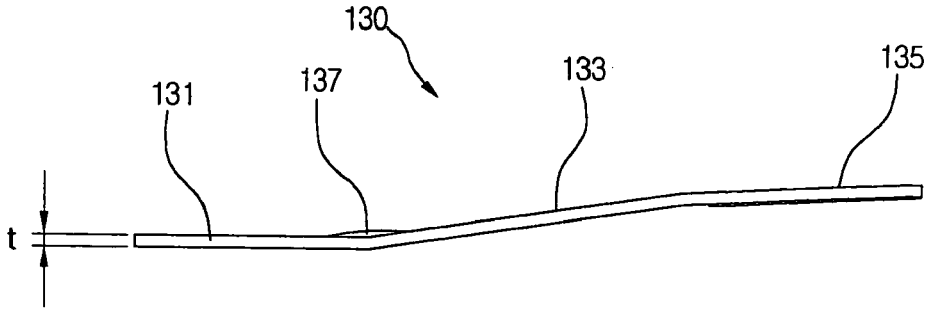
FIG. 7 is a side view of a mask spring of the present invention.
Figure 8:
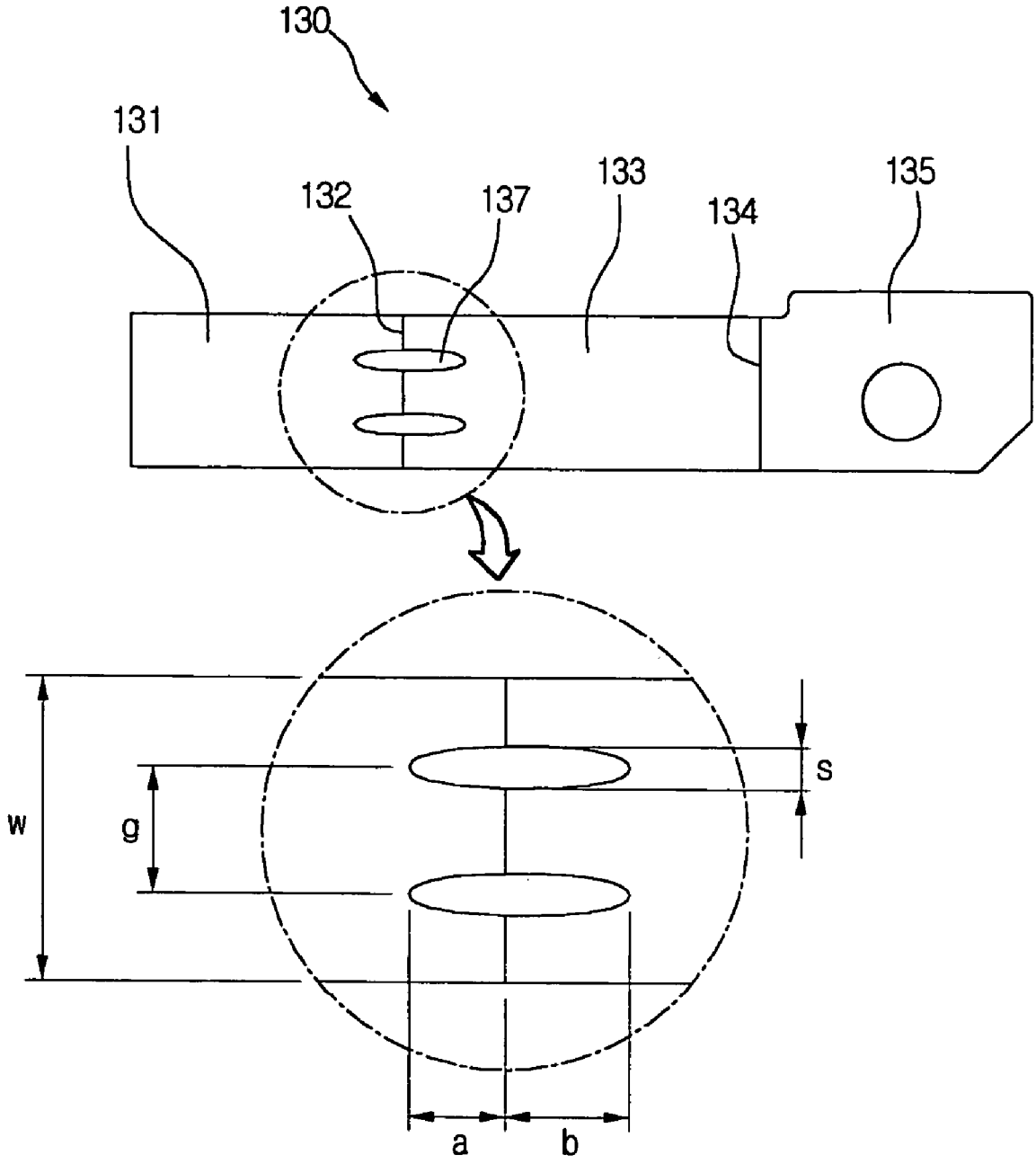
FIG. 8 is a plan view of a mask spring of the present invention.

FIG. 5 is a perspective view of a mask spring of the present invention, FIG. 6 is a rear perspective view of the mask spring, FIG. 7 is a side view of the mask spring, and FIG. 8 is a plan view of the mask spring.

Referring to FIGS. 5 through 8, the mask spring 130 includes an fastening portion 131 that is welded to a mask frame 120, a attaching portion 135 that is incorporated with a stud pin formed inside a panel, and a connecting portion 133 that connects the fastening portion 131 with the attaching portion 135.

The fastening portion 131 and the connecting portion 133 are tilted at a designated angle from a bending portion 132, and the attaching portion 135 and the connection portion 133 are tilted at a designated angle from another bending portion 134.

According to a preferred embodiment of the present invention, elongated embossments of the mask spring 130 are formed on the bending portion 132 between the fastening portion 131 and the connecting portion 133.

Figure 1:
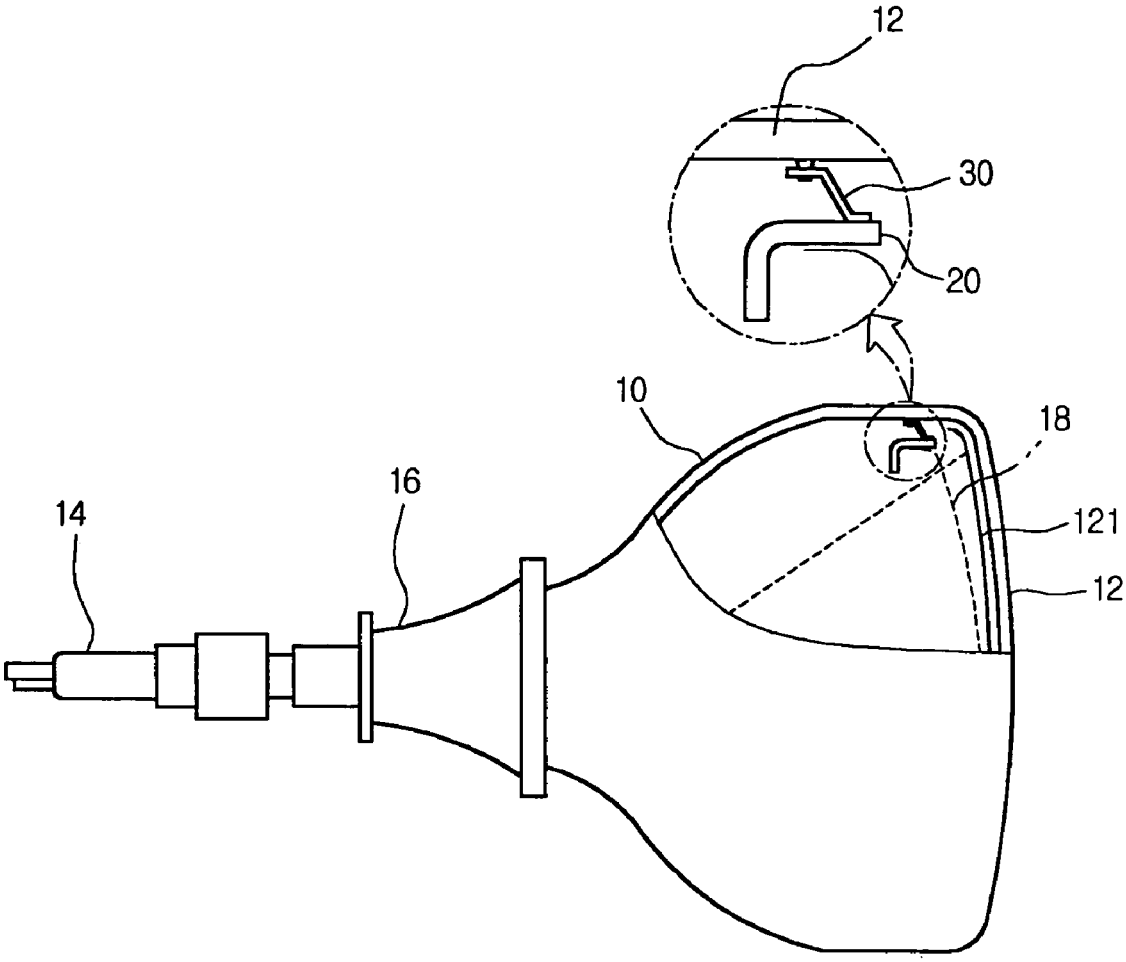
Fig.1 Related Art
FIG. 1 illustrates the structure of a related art cathode ray tube and mask spring.
Figure 2:
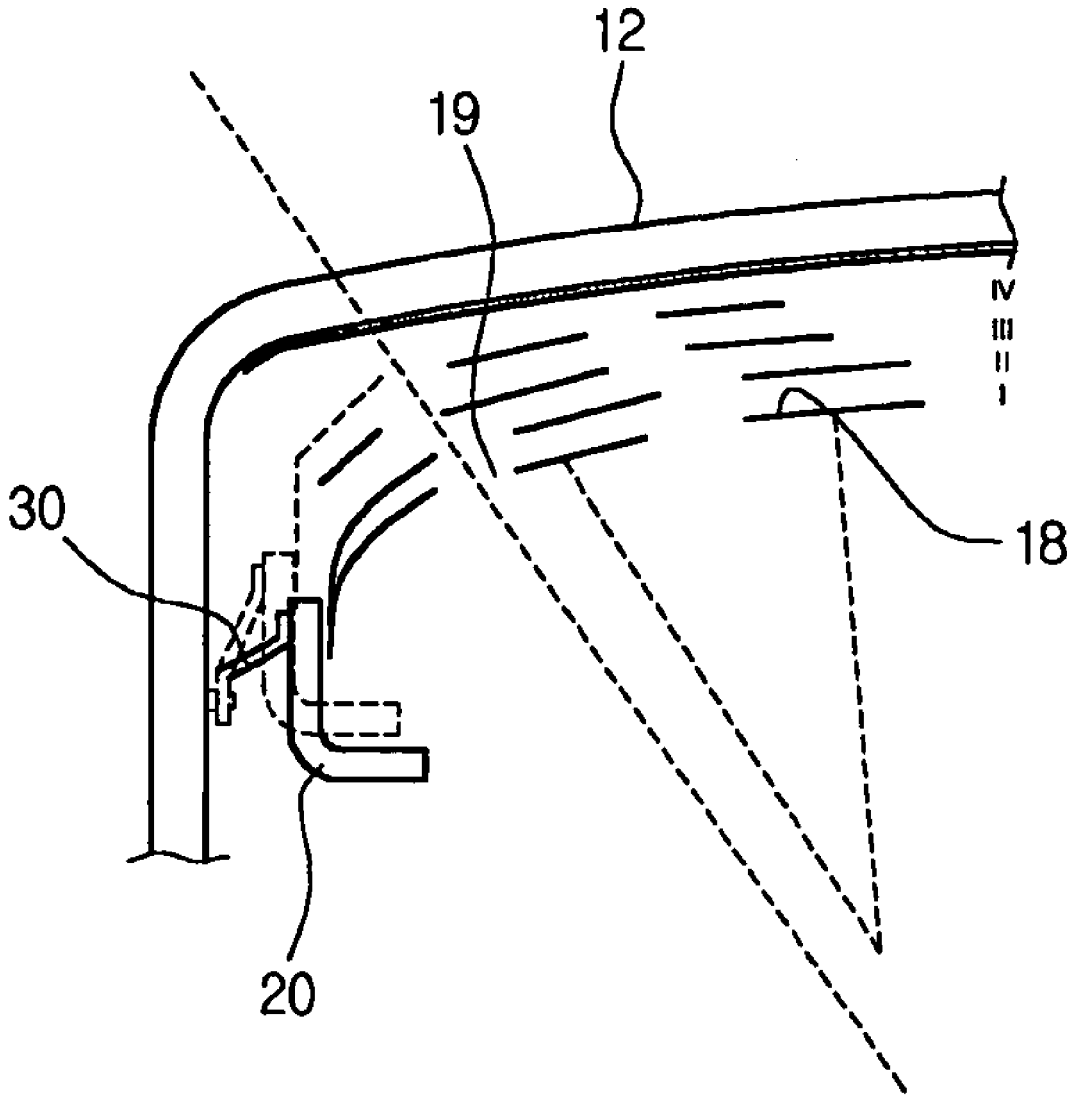
Fig.2 Related Art
FIG. 2 illustrates a thermally expanding shadow mask.
Figure 3:
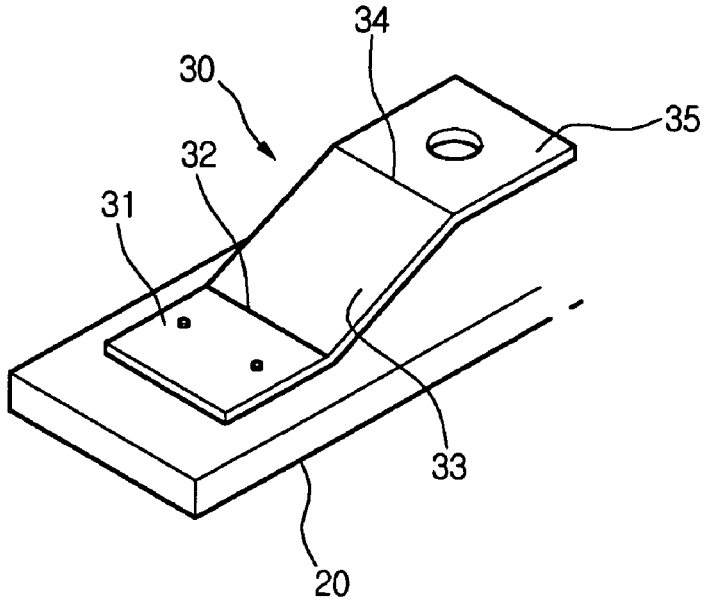
Fig.3 Related Art
FIG. 3 is a perspective view of the structure of a mask spring attached to a mask frame.
Figure 4:
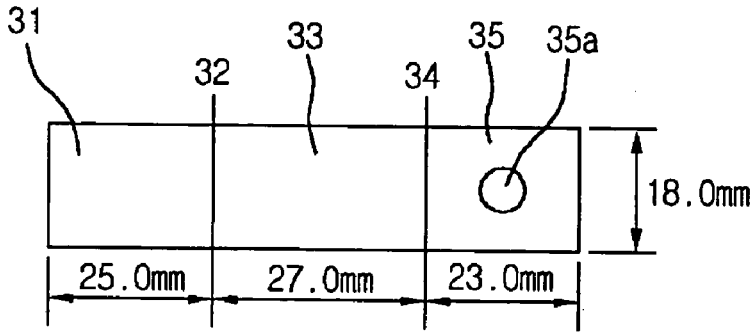
Fig.4 Related Art
FIG. 4 is a plan view of a mask spring.

Although FIG. 2 illustrates two embossments 137, a plurality of embossments can actually be formed on the bending portion.

As depicted in FIG. 8, the embossments 137 are asymmetric with respect to the bending portion 132. Suppose a distance from the bending portion 132 to an end of the embossment in the direction of the connecting portion 133 is 'b', and a distance from the bending portion 132 to an end of the embossment in the direction of the fastening portion 131 is 'a'. Then, the lengths of the embossment 137, a and b, satisfy a relation of $a<b$.

More preferably, the 'a' and 'b' satisfy a condition of $0.6 \leqq b/(a+b) \leqq 0.9$. In other words, the length 'b', namely the distance from the bending portion 132 to the end of the embossment 137 in the direction of the connecting portion 133 composes 60–90% the total length (a+b) of the embossment 137.

Meanwhile, a gap between two centers of the embossments 137 ranges from 3 to 7 mm, and the total length (a+b) of the embossments ranges 2 to 8 mm, each of the embossments having an oval shape.

Preferably, a width 's' of each of the embossments 137, and the total length (a+b) of each of the embossments 137 satisfy a condition of $0.3 \leqq s/(a+b) \leqq 0.5$. That is to say, the width of the embossment 137 is 30–50% of its total length (a+b).

Moreover, a width of the mask spring 130 is in the range of 10–20 mm, and the width (s) of the embossment is less than 3 mm.

As FIG. 7 illustrates, a thickness (t) of the mask spring 130 ranges from 0.4 to 0.8 mm, and a thickness (t) of the mask spring 130 is 2–6% of a width (w) of the bending portion 132.

In short, the thickness (t) of the mask spring 130 and the width (w) of the bending portion 132 satisfy a condition of $0.02 \leqq t/w \leqq 0.06$.

Also, as shown in FIG. 6, a depth (d) of the embossment 137 where the embossment is caved in composed 30–50% of the thickness (t) of the mask spring 130. In other words, the depth (d) of the embossment 137 and the thickness (t) of the mask spring 130 satisfy a condition of $0.3 \leqq d/t \leqq 0.5$.

Preferably, the depth (d) of the embossment is less than 0.3 mm.

In conclusion, forming the embossments 137 on the mask spring 130, the strength of the mask spring is enhanced, and thus the drop characteristic can be reinforced.

Also, manufacturers are now able to reduce the cost of manufacture while improving the howling characteristic, by reducing the thickness of the mask spring 130 down to 2–6% of the width of the bending portion 132.

While the invention has been shown and described with reference to certain preferred embodiments thereof, it will be understood by those skilled in the art that various changes in form and details may be made therein without departing from the spirit and scope of the invention as defined by the appended claims.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A cathode ray tube comprising:

a panel having a fluorescent formed on an inner surface thereof a funnel fastened to the panel;

an electron gun housed in the funnel, emitting electron beams;

a shadow mask for selecting colors of the electron beams;

a mask frame for supporting the shadow mask; and a mask spring for coupling the mask frame to the panel, wherein the mask spring includes a fastening portion welded to the mask frame, an attaching portion attached to the panel, and a connecting portion for connecting the fastening portion with the attaching portion, wherein elongated embossments are formed on a bending portion formed between the fastening portion and the connecting portion, and wherein the embossments are asymmetric with respect to the bending portion.

2. The cathode ray tube according to claim 1, wherein each of the embossments is in an oval shape approximately.

3. The cathode ray tube according to claim 1, wherein a thickness of the mask spring is in the range of 0.4–0.8 mm.

4. The cathode ray tube according to claim 1, wherein a thickness of the mask spring, t, and a width of the bending portion, w, satisfy a condition of $0.02 \leqq t/w \leqq 0.06$.

5. The cathode ray tube according to claim 1, wherein a distance from the bending portion to an end of the embossment in a direction of the connecting portion, b, and a distance from the bending portion to an end of the embossment in a direction of the fastening portion, a, satisfy a condition of $a<b$.

6. The cathode ray tube according to claim 5, wherein the distance from the bending portion to the end of the embossment in the direction of the connecting portion, b, and a total length of the embossment, a+b, satisfy a condition of $0.6 \leqq b/(a+b) \leqq 0.9$.

7. The cathode ray tube according to claim 1, wherein a distance from the bending portion to an end of the embossment in a direction of the connecting portion, b, and a distance from the bending portion to an end of the embossment in a direction of the fastening portion, a, satisfy a condition of $a<b$.

8. The cathode ray tube according to claim 7, wherein the distance from the bending portion to the end of the embossment in the direction of the connecting portion, b, and a total length of the embossment, a+b, satisfy a condition of $0.6 \leqq b/(a+b) \leqq 0.9$.

9. The cathode ray tube according to claim 1, wherein a plurality of the embossments is formed on the bending portion.

10. The cathode ray tube according to claim 9, wherein a gap between centers of the embossments is in the range of 3–7 mm.

11. The cathode ray tube according to claim 1, wherein a depth of each of the embossments, d, where the embossment is caved in, and a thickness of the mask spring, t, satisfy a condition of $0.4 \leqq d/t \leqq 0.6$.

12. The cathode ray tube according to claim 1, wherein a depth of each of the embossments is less than 0.3 mm.

13. The cathode ray tube according to claim 1, wherein a depth of the embossment, s, and a total length of the embossment, a+b, satisfy a condition of $0.3 \leqq s/(a+b) \leqq 0.5$.

14. The cathode ray tube according to claim 1, wherein a width of the embossment is less than 3 mm.

15. The cathode ray tube according to claim 1, wherein a length of the embossment is in the range of 2–8 mm.

16. The cathode ray tube according to claim 1, wherein a width of the mask spring is in the range of 10–20 mm.

17. A cathode ray tube comprising:

a panel having a fluorescent formed on an inner surface thereof;

a funnel fastened to the panel;

an electron gun housed in the funnel, emitting electron beams;

a shadow mask for selecting colors of the electron beams;

a mask frame for supporting the shadow mask; and a mask spring for coupling the mask frame to the panel, wherein the mask spring includes a fastening portion welded to the mask frame, an attaching portion attached to the panel, and a connecting portion for connecting the fastening portion with the attaching portion, wherein elongated embossments are formed on a bending portion formed between the fastening portion and the connecting portion, and wherein a distance from the bending portion to an end of the embossment in a direction of the connecting portion, b, and a distance from the bending portion to an end of the embossment in a direction of the fastening portion, a, satisfy a condition of $a<b$.

18. The cathode ray tube according to claim 17, wherein the distance from the bending portion to the end of the embossment in the direction of the connecting portion, b, and a total length of the embossment, a+b, satisfy a condition of $0.6 \leqq b/(a+b) \leqq 0.9$.

19. A cathode ray tube comprising:

a panel having a fluorescent formed on an inner surface thereof;

a funnel fastened to the panel;

an electron gun housed in the funnel, emitting electron beams;

a shadow mask for selecting colors of the electron beams;

a mask frame for supporting the shadow mask; and a mask spring for coupling the mask frame to the panel, wherein the mask spring includes a fastening portion welded to the mask frame, an attaching portion attached to the panel, and a connecting portion for connecting the fastening portion with the attaching portion, wherein elongated embossments are formed on a bending portion formed between the fastening portion and the connecting portion, and wherein a depth of each of the embossments, d, where the embossment is caved in, and a thickness of the mask spring, t, satisfy a condition of $0.4 \leqq d/t \leqq 0.6$.

20. A cathode ray tube comprising:

a panel having a fluorescent formed on an inner surface thereof;

a funnel fastened to the panel;

an electron gun housed in the funnel, emitting electron beams;

a shadow mask for selecting colors of the electron beams;

a mask frame for supporting the shadow mask; and a mask spring for coupling the mask frame to the panel, wherein the mask spring includes a fastening portion welded to the mask frame, an attaching portion attached to the panel, and a connecting portion for connecting the fastening portion with the attaching portion, wherein elongated embossments are formed on a bending portion formed between the fastening portion and the connecting portion, and wherein a depth of the embossment, s, and a total length of the embossment, a+b, satisfy a condition of $0.3 \leqq s/(a+b) \leqq 0.5$.

* * * * *